US006725702B2

(12) United States Patent
Tolkamp et al.

(10) Patent No.: US 6,725,702 B2
(45) Date of Patent: Apr. 27, 2004

(54) APPARATUS AND METHOD FOR OVERCOMING ANGULAR DEVIATIONS IN A WORKPIECE

(75) Inventors: John Christian Tolkamp, Surrey (CA); Einar Edwardson Hilton, Surrey (CA)

(73) Assignee: Ariel Financing Ltd., White Rock (CA)

( * ) Notice: Subject to any disclaimer, the term of this patent is extended or adjusted under 35 U.S.C. 154(b) by 26 days.

(21) Appl. No.: 10/045,957

(22) Filed: Oct. 26, 2001

(65) Prior Publication Data

US 2003/0079518 A1 May 1, 2003

(51) Int. Cl.[7] ..... B21D 5/02; B30B 15/02; B21J 13/03

(52) U.S. Cl. ..... 72/389.4; 72/389.4

(58) Field of Search ..... 72/389.4, 389.5, 72/389.6

(56) References Cited

U.S. PATENT DOCUMENTS

| | | | | |
|---|---|---|---|---|
| 3,962,777 A | | 6/1976 | Stoilov | 29/568 |
| 3,965,721 A | | 6/1976 | Roch | 72/462 |
| 3,969,955 A | | 7/1976 | Markham | 74/613 |
| 3,982,452 A | | 9/1976 | Scheiffele | 82/36 |
| 4,030,364 A | | 6/1977 | Atwood | 72/389 |
| 4,036,343 A | | 7/1977 | McPhee | 192/134 |
| 4,041,765 A | | 8/1977 | Kemper | 72/389 |
| 4,166,369 A | | 9/1979 | Nakajima | 72/26 |
| 4,347,727 A | | 9/1982 | Galiger | 72/389 |
| 4,354,374 A | | 10/1982 | Deguchi | 72/389 |
| 4,402,389 A | | 9/1983 | Adams et al. | 192/134 |
| 4,449,389 A | | 5/1984 | Cros | 72/389 |
| 4,488,237 A | | 12/1984 | Aronson et al. | 364/476 |
| 4,510,789 A | | 4/1985 | Tomioka et al. | 72/442 |
| 4,535,619 A | | 8/1985 | Gargrave | 72/481 |
| 4,564,765 A | | 1/1986 | Blaich | 250/561 |
| 4,612,796 A | | 9/1986 | Smyth, Jr. | 72/481 |
| 4,680,955 A | | 7/1987 | Sakamoto | 72/462 |
| 4,721,293 A | | 1/1988 | Schron et al. | 269/32 |
| 4,732,032 A | | 3/1988 | Kogure | 72/389 |
| 4,758,122 A | | 7/1988 | Kubo | 409/233 |
| 4,787,237 A | | 11/1988 | Houston et al. | 72/462 |
| 4,802,357 A | | 2/1989 | Jones | 72/389 |
| 4,845,834 A | | 7/1989 | Watson | 29/568 |
| 4,864,727 A | | 9/1989 | Chu | 30/272.1 |
| 4,895,014 A | | 1/1990 | Houston | 72/481 |
| 4,898,015 A | | 2/1990 | Houston | 72/389 |
| 4,907,432 A | | 3/1990 | Maillefer | 72/1 |
| 4,926,671 A | | 5/1990 | Hill | 72/389 |
| 4,930,339 A | * | 6/1990 | Corsini | 72/389.4 |
| 4,948,309 A | | 8/1990 | Newland et al. | 409/234 |
| 5,009,098 A | | 4/1991 | Van Merksteijn | 72/389 |
| 5,037,254 A | | 8/1991 | Asberg | 409/233 |

(List continued on next page.)

FOREIGN PATENT DOCUMENTS

| | | | | |
|---|---|---|---|---|
| EP | 0067766 | | 10/1986 | |
| EP | 0330258 | | 2/1991 | |
| GB | 2 188 266 A | | 9/1987 | |
| JP | 60-244425 | * | 12/1985 | 72/389.4 |
| JP | 2-147120 | * | 6/1990 | 72/389.4 |

*Primary Examiner*—David Jones
(74) *Attorney, Agent, or Firm*—Squire, Sanders & Dempsey, LLP

(57) ABSTRACT

Apparatus for adjusting the shape of an elongate die rail in press equipment comprising a plurality of interconnected shaping members spaced apart from each other and extending longitudinally along the inner surface of the die rail. The shaping members are adapted to permit adjustment of an overall curved shape of the elongate outer surface of the die rail by coordinated longitudinal movement, relative to the die rail, of groups of the shaping members with respect to each other. The shaping members are adapted to permit adjustment of one or more localized portions of the overall shape of the elongate outer surface of the die rail by independent longitudinal movement of one or more individual shaping members relative to the die rail outer surface.

26 Claims, 7 Drawing Sheets

U.S. PATENT DOCUMENTS 5,060,495 A 10/1991 Naoomi et al. ..... 72/10
5,062,283 A 11/1991 Miyagawa et al. ..... 72/10
5,065,610 A 11/1991 Yonezawa ..... 72/462
5,067,340 A 11/1991 MacGregor ..... 72/389
5,103,665 A 4/1992 Van Merksteijn ..... 72/389
5,121,626 A 6/1992 Baldwin ..... 72/482
5,134,873 A 8/1992 Miyagawa et al. ..... 72/446
5,146,774 A 9/1992 Smith ..... 72/446
5,168,745 A 12/1992 Miyagawa et al. ..... 72/446
5,211,045 A 5/1993 Shimizu ..... 72/22
5,277,687 A 1/1994 Shimoichi et al. ..... 483/28
5,366,431 A 11/1994 Smith et al. ..... 483/1
5,390,527 A 2/1995 Kawano ..... 72/481
5,507,170 A 4/1996 Kawano ..... 72/482.91
5,511,407 A 4/1996 Kawano ..... 72/482.91
5,513,514 A 5/1996 Kawano ..... 72/482.91
5,572,902 A 11/1996 Kawano ..... 72/482.91
5,579,884 A 12/1996 Appleyard et al. ..... 192/130
5,615,746 A 4/1997 Chu ..... 173/171
5,619,885 A 4/1997 Kawano et al. ..... 72/481.8
5,620,406 A 4/1997 Bae ..... 483/39
5,642,642 A 7/1997 Kawano ..... 72/482.91
5,644,915 A 7/1997 Dressing et al. ..... 60/426
5,662,442 A 9/1997 Taki et al. ..... 409/233
5,685,191 A 11/1997 Kawano et al. ..... 72/482.91
5,794,486 A 8/1998 Sugimoto et al. ..... 72/481.3
5,813,273 A 9/1998 Hongo ..... 72/389.4
5,839,310 A 11/1998 Tokai et al. ..... 72/31.1
5,983,688 A 11/1999 Anzai et al. ..... 72/15.1
5,997,455 A 12/1999 Matsuoka et al. ..... 483/56
6,000,273 A 12/1999 Stover ..... 72/482.3
6,003,360 A 12/1999 Runk et al. ..... 72/482.2
6,018,979 A * 2/2000 Davis ..... 72/389.4
6,032,509 A 3/2000 Nagakura ..... 72/389.5
6,050,741 A 4/2000 Aultman et al. ..... 403/374.1
6,105,491 A 8/2000 Dunaj ..... 100/99
6,131,429 A 10/2000 Ward ..... 72/1
6,138,492 A 10/2000 Vining et al. ..... 72/481.1
6,145,366 A 11/2000 Yamada ..... 72/443
6,185,476 B1 2/2001 Sakai ..... 700/182
6,189,364 B1 2/2001 Takada ..... 72/702
6,193,125 B1 2/2001 Grover ..... 224/575

* cited by examiner

APPARATUS AND METHOD FOR OVERCOMING ANGULAR DEVIATIONS IN A WORKPIECE

BACKGROUND OF THE INVENTION

1. Field of the Invention

The present invention relates to an apparatus and method for overcoming angular deviations in a workpiece, and, more particularly to an apparatus and method for permitting crowning and localized adjustment of bending surfaces of press equipment in order to compensate for sagging and irregularities in the shape of the surfaces.

2. General Background and State of the Art

Traditional press equipment, such as a press brake has a stationary lower bed with an elongate surface for supporting a first press tool and a moveable upper bed with an elongate surface for supporting a second press tool. Generally, the first press tool associated with the stationary bed is a forming die held in a die holder and the second press tool is a punch. In operation, the moveable bed or ram is moved downwardly toward the forming die to bend, shape or otherwise form a workpiece placed between the forming die and the punch. Alternatively, the lower bed may be configured to move upwardly towards a stationary upper bed.

The compressive forces applied to the workpiece by the co-operating punch and die are quite high, generally exceeding several tons. As the upper and lower beds that support the punch and die are typically supported at their longitudinal ends, sagging of the beds tends to occur. In addition, irregularities in the bed surfaces or the press tools can result in non-constant bending of the workpiece over the length of the workpiece.

Various arrangements are used to overcome sagging. In a technique referred to as crowning adjustment, the overall curvature of the surface of at least one of the beds is adjusted to compensate for sagging. A convex curvature is termed positive crown, while a concave curvature is a negative crown. One such crowning arrangement is shown in U.S. Pat. No. 4,898,015 to Houston. This arrangement includes two transverse wedges which extend over the length of the beds of the press brake.

Although such arrangements are used to adjust the overall curvature of the beds, there is still a need to compensate for localized irregularities due to such factors as wear and machining tolerances. This is generally achieved in a technique commonly called localized adjusting which involves raising or lowering the bed surface at particular locations to compensate for local irregularities.

U.S. Pat. No. 5,009,098 to Van Merksteijn is an example of an arrangement that provides for both crowning and localized adjusting. Van Merksteijn includes curve-forming members slidable over each other in the lengthwise direction for crowning adjustment, and in the transverse direction for localized adjustment. However, crowning and localized adjustment by distortion of the curve-forming member both longitudinally and transversely can cause the arrangement to be susceptible to failure due to compound stresses. In addition, because the curve-forming members are unitary pieces, transverse movement to effect localized adjustment at one position of the bed surfaces tends to inadvertently affect localized adjustment at immediately adjacent positions. The result is that localized adjustment can become a time consuming iterative process which involves making an adjustment at the desired position, measuring the shape of the bed surface adjacent the desired position to determine how it has been affected, making adjustments to remove inadvertently introduced changes, and then going back to determine any introduced changes at the desired position.

Therefore, it would be desirable to have an alternative apparatus and method that provides for crowning and localized adjustment of the bed of press equipment. It would be further desirable to have an apparatus and method that provides an improved technique for localized adjustment.

INVENTION SUMMARY

In accordance with one aspect of the present invention there is provided an apparatus for adjusting the shape of an elongate surface having inner and outer surfaces comprising a plurality of interconnected shaping members spaced apart from each other and extending longitudinally along the inner surface, the shaping members adapted to permit adjustment of an overall curved shape of the elongated outer surface by co-ordinated longitudinal movement, relative to the elongated surface, of groups of the shaping members with respect to each other and adapted to permit adjustment of one or more localized portions of the overall shape of the elongated outer surface by independent longitudinal movement of one or more individual shaping members relative to the elongated outer surface.

The shape forming system may be positioned in a longitudinal groove of a die rail positioned on the lower bed surface of a press brake.

In accordance with another aspect of the invention there is provided a press comprising:

a frame;

an upper bending member and a lower bending member supported by the frame, the upper and lower bending members being moveable relative to each other to apply force to a workpiece placed between the upper and lower bending members; and a shape forming system associated with at least one of the upper and lower bending members for adjusting the shape of the bending member, the shape forming system comprising a plurality of interconnected shaping members spaced apart from each other and extending along the bending member to permit adjustment of the overall curved shape of the bending member by co-ordinated slidable movement of the shaping members over each other in a longitudinal direction relative to the bending member and to permit localized adjustment of one or more portions of the overall shape of the bending member by independent longitudinal movement of one or more of the shaping members relative to the bending member.

In another aspect of the present invention there is also provided an apparatus for adjusting the shape of an elongate bed member in press equipment, the bed member being formed with a channel to define an elongate inner surface opposite an elongate outer surface comprising:

a plurality of shaping members insertable within the channel to extend longitudinally of and engage the inner surface, each shaping member being formed from a wedge member and an associated link member movable with respect to the wedge member, each link member being connected to adjacent link members;

whereby co-ordinated slidable longitudinal movement of the link members over the wedge members permits adjustment of the overall curved shape of the outer surface and independent slidable longitudinal movement of individual wedge members permits adjustment of one or more localized portions of the overall shape of the outer surface.

Each wedge member may be formed with an inclined surface at angle $\alpha$ and the wedge members may be arranged in a pattern along the elongated surface such that angle $\alpha$ decreases from the middle of the elongated surface to distal ends of the elongated surface.

Each link member may include a base member and a contact member mounted together to permit pivoting movement of the contact member with respect to the base member to maintain contact with the longitudinal surface. Each base member and contact member may be formed with one of an opposed mutually engaging convex and concave surface to permit pivoting of the contact member. The base members may be interconnected by rigid links having two ends. Each rigid link may be pivotally mounted to each base member.

In yet another aspect, there is provided a method for adjusting the shape of a elongate surface having an outer surface and an inner surface comprising the steps of:

providing a plurality of interconnected shaping members spaced apart from each other and extending longitudinally along the inner surface;

moving the shaping members as a group in a longitudinal direction relative to the outer surface to adjust the overall curved shape of the elongated outer surface; and moving one or more individual shaping member independently in a longitudinal direction relative to the outer surface to adjust one or more localized portions of the overall shape of the elongated outer surface.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Aspects of the present invention are illustrated, by way of example, in the accompanying drawings, in which.

DETAILED DESCRIPTION OF THE INVENTION

Figure 1:
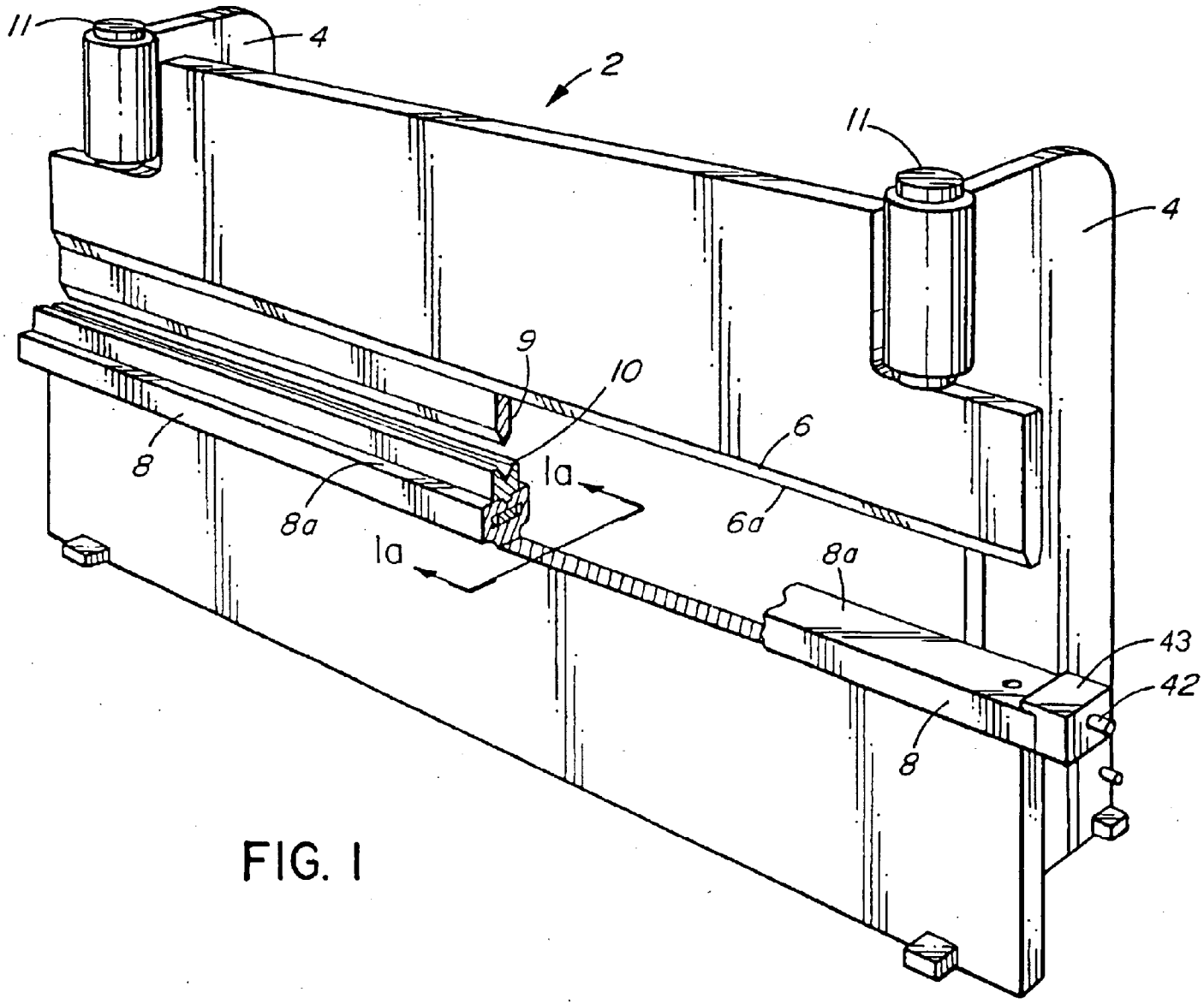
FIG. 1 is perspective view of a press brake according to a first embodiment of the present invention.

Referring to FIG. 1, there is shown sample press equipment 2 according to a first embodiment of the present invention. The equipment 2 illustrated is a press brake which will be described in some detail by way of example. It will be understood that the present invention is not limited to a press brake and finds application in any press equipment that relies on moving surfaces together to bend a workpiece therebetween. It will be appreciated that a variety of workpieces may be manipulated with press equipment including, by way of example, sheet metal.

The press brake shown in FIG. 1 comprises a frame formed from a pair of spaced upstanding supports 4 that support an upper bending mechanism and a lower bending mechanism moveable relative to each other to apply force to a workpiece placed between the bending mechanisms. Preferably, the upper and lower bending mechanisms comprise a movable upper bed 6 and a stationary lower bed 8. Upper bed 6 and lower bed 8 are formed with elongate surfaces 6*a* and 8*a*, respectively. In the illustrated example, elongate surface 6*a* provides a mounting point for attachment of a first upper press tool in the form of a punch 9. Elongate surface 8*a* supports a second lower press tool in the form of a die 10 formed with a groove to receive the punch and guide bending of the workpiece. In operation, upper bed 6 and punch 9 are moved downwardly toward die 10 by hydraulic actuators 11 to bend, shape or otherwise form a workpiece (not shown) placed between the die 10 and the punch 9. While the illustrated arrangement shows a movable upper tool being moved toward a stationary lower tool, the press equipment may be configured to operate in the opposite manner such that a lower tool is moved upwardly to engage a stationary upper tool. It is sufficient that the upper and lower tools be supported for movement relative to each other. It will also be appreciated that actuators 11, although hydraulic in the first embodiment for illustrative purposes, can be mechanical, hydromechanical, electric or the like.

In order to compensate for factors such as deformation, sagging and irregularities in the press tools, press brake 2 incorporates a shape forming mechanism in the form of a shaping system associated with at least one of the upper and lower press tools for adjusting the shape of the associated upper or lower press tool by adjusting the shape of the surface supporting the associated press tool. In the illustrated embodiment, the shaping system is housed within stationary lower bed 8 below die tool 10 and acts to adjust the shape of surface 8*a*. It will be appreciated that the shape forming system could alternatively be housed within upper bed 6 to adjust the shape of surface 6*a* or housed within both the upper and lower beds.

Figure 1A:
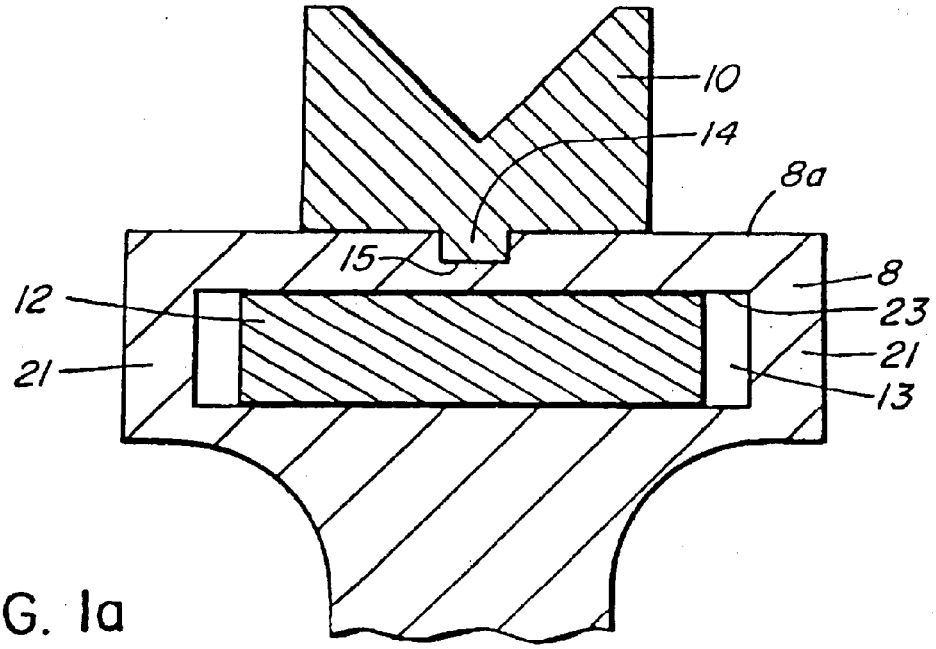
FIG. 1*a* is a detail section view taken along line 1*a*—1*a* of FIG. 1 showing the shaping system of the first embodiment within a press bed.

Referring to FIG. 1*a*, there is shown a cross-section view through lower bed 8 taken along line 1*a*—1*a* of FIG. 1 showing schematically shaping system 12 housed within a longitudinal channel 13 formed in the lower bed and extending along the length of the lower bed 8. The shaping system 12 acts to adjust the over all curved shape and localized shape of surface 8*a* which in turn affects the shape of die 10 positioned atop surface 8*a* via a conventional mounting scheme involving a tongue 14 received in a groove 15 formed in surface 8*a*.

Figure 1B:
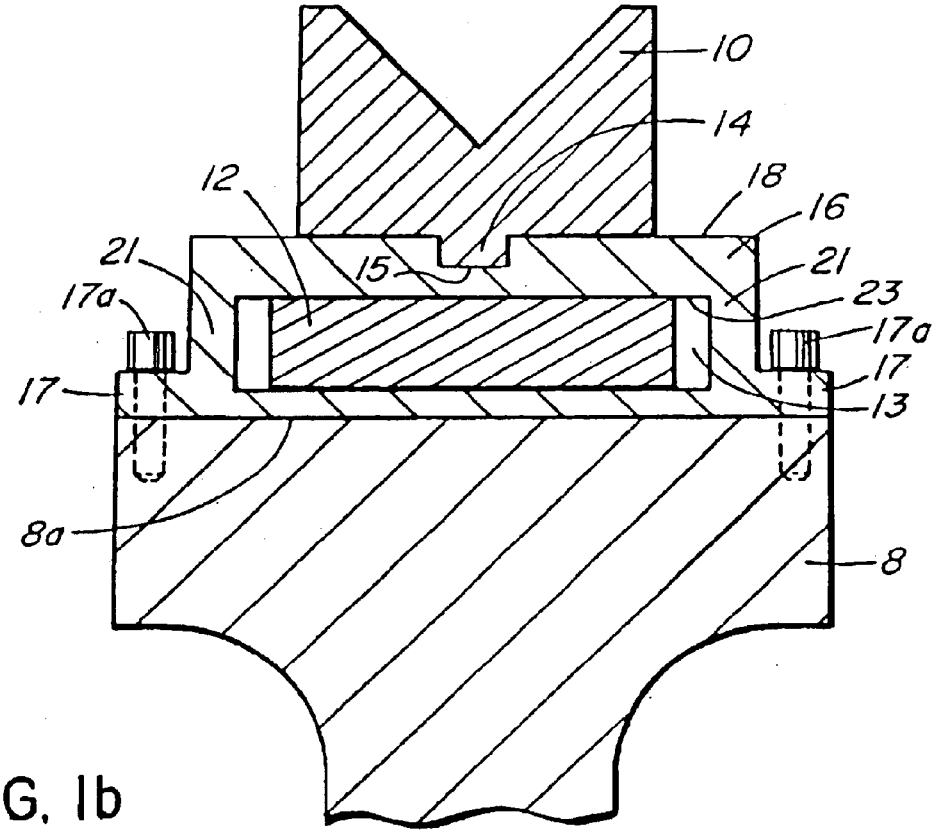
FIG. 1*b* is a detail section view showing the shaping system of the present invention within a retrofittable rail.

In FIG. 1*a*, shaping system 12 is incorporated into the press bed 8. As shown in FIG. 1*b* in another aspect, a retrofittable rail 16 can be mounted adjacent to an existing press bed 8 to convert a conventional press brake into one that incorporates shaping system 12. Rail 16 includes mounting brackets 17 by which the rail can be fastened to surface 8*a* of bed 8 using threaded fasteners 17*a*. Rail 16 includes an outer surface 18 that is shaped by shaping system 12. In the illustrative embodiment, outer surface 18 includes a groove 15 to receive the tongue 14 of die 10. The components and the operation of shaping system 12 are substantially the same whether the shaping system is incorporated in retrofittable rail 16 or directly within press bed 8.

It will be appreciated that the tongue 14 and groove 15 arrangement can be replaced with other configurations for mounting die 10 to the rail 16 or the press bed 8. For instance, with rail 16 or press bed 18, groove 15 can be made the width of die 10 so as to form a channel within which die 10 can be placed.

Figure 2:
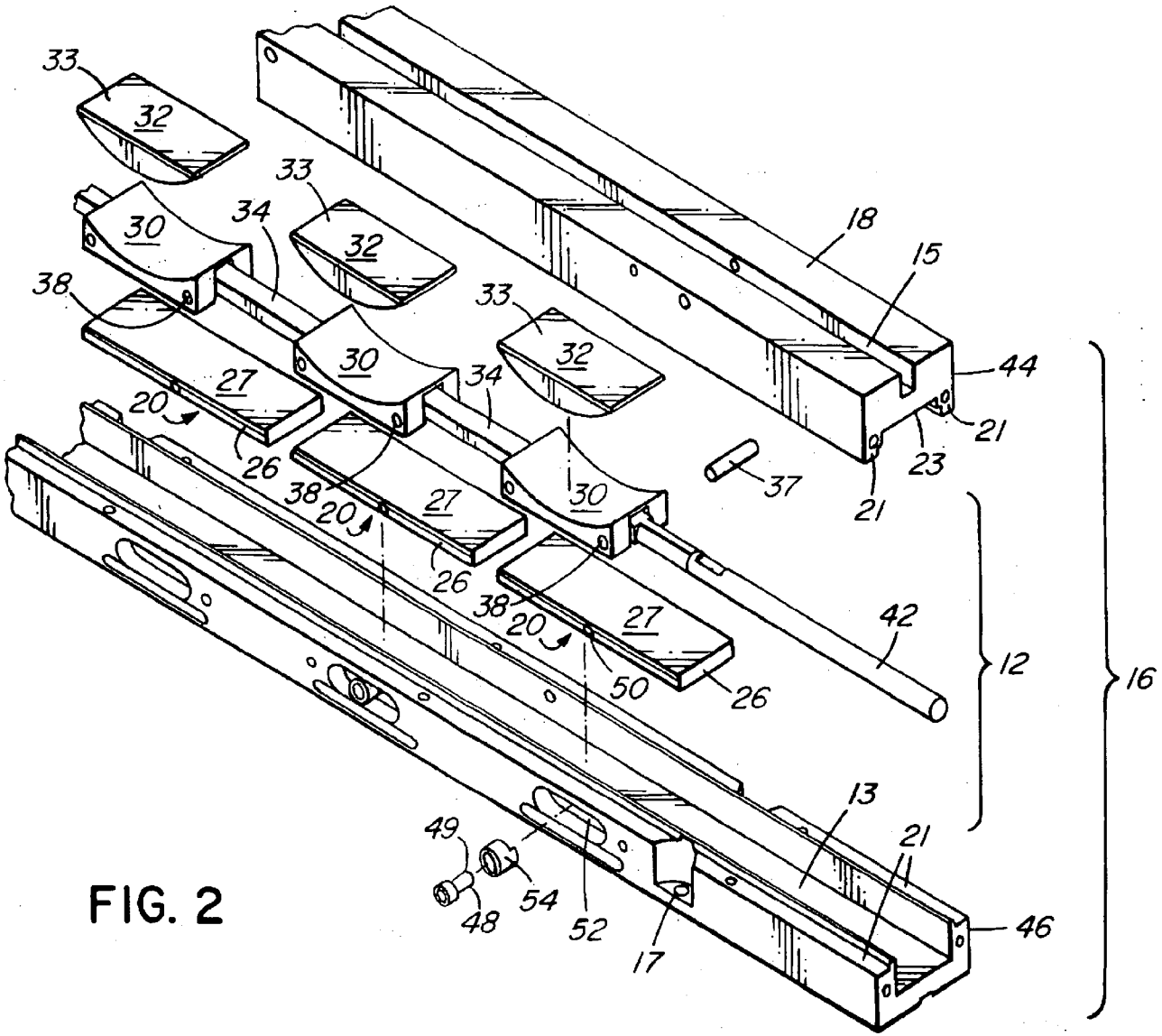
FIG. 2 is an detail exploded view of the components of a preferred embodiment of the present invention showing the shaping members.
Figure 3:
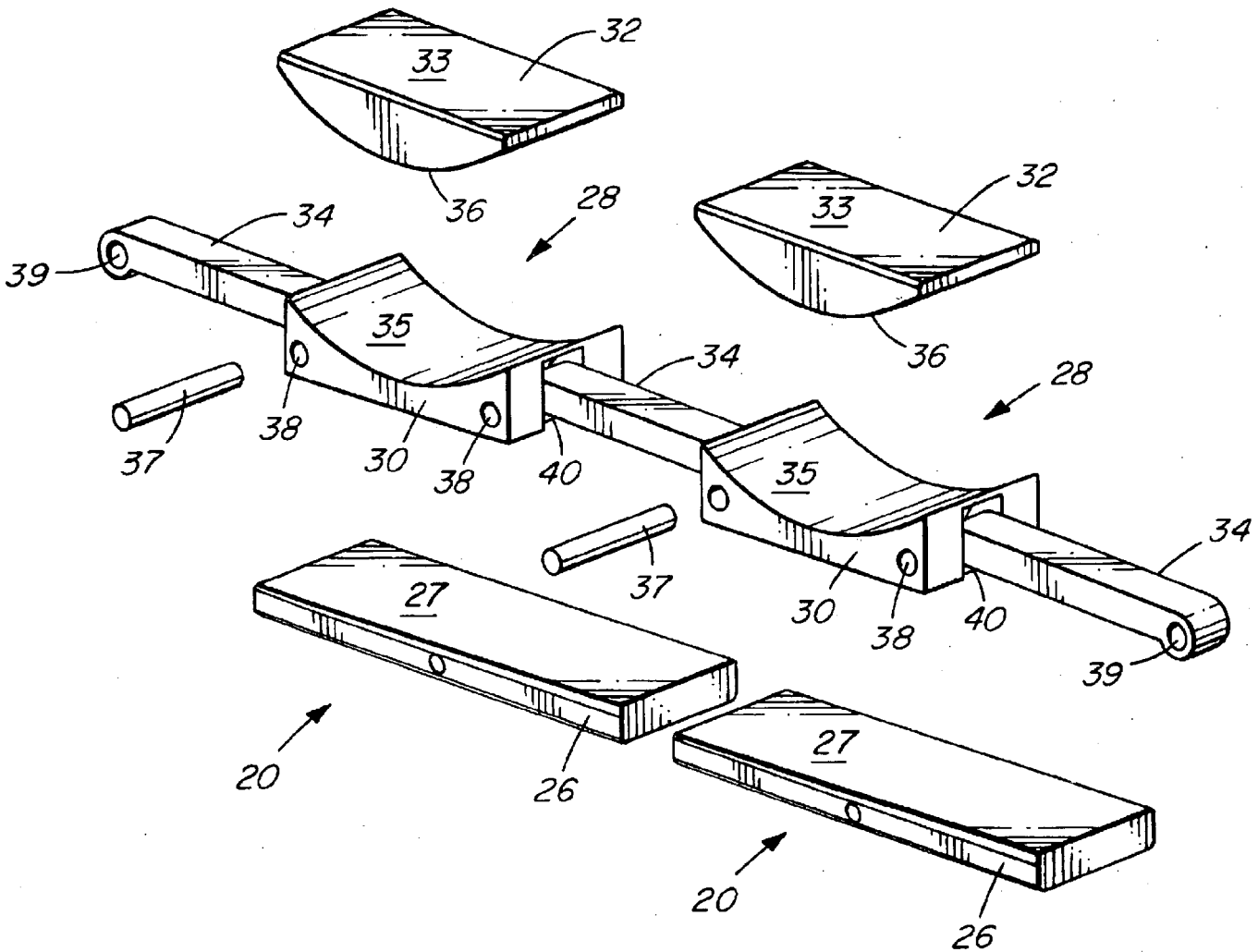
FIG. 3 is an exploded view showing further details of the shaping members of FIG. 2.
Figure 4:
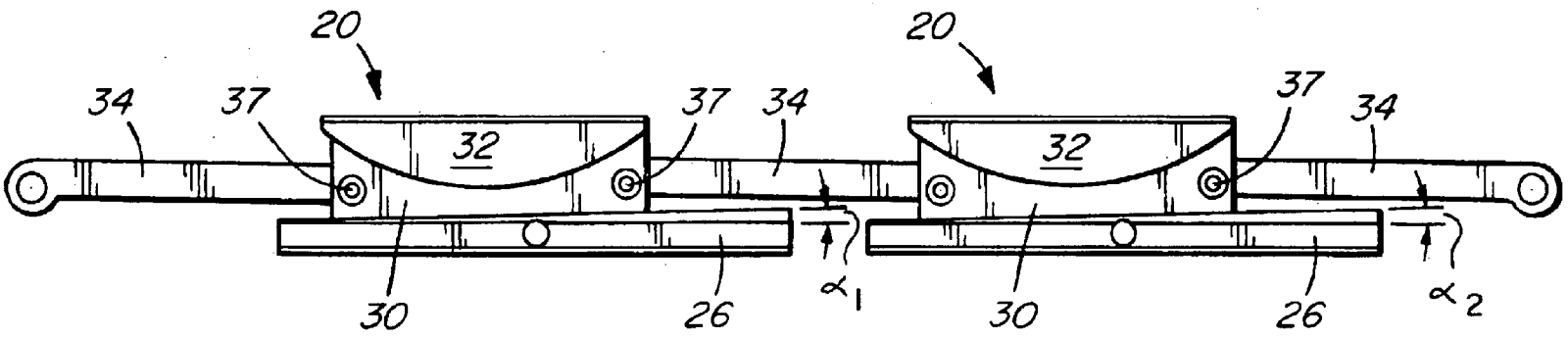
FIG. 4 is a front elevation view of the assembled shaping members of FIG. 2.

The shaping system 12 of the embodiment in FIG. 1*b* is further illustrated in FIGS. 2 to 4 which show exploded and assembled views of the shaping system 12. The discussion which follows is equally applicable to the embodiment of the shaping system 12 shown in FIG. 1*a*.

FIG. 2 shows the shaping system positioned within retrofittable rail 16 which preferably comprises an upper bar 44 and a lower bar 46 that define therebetween longitudinal channel 13. Upper bar 44 includes outer surface 18 formed with die mounting groove 15 and lower bar 46 includes brackets 17 for mounting the assembled rail to the press bed. Each bar 44 and 46 includes side walls 21 that interlock together to enclose and house the assembled shaping system 12. Preferably, threaded fasteners (not shown) extending generally vertically through the upper and lower bars lock the bars together.

The shaping system 12 comprises a plurality of interconnected shaping members 20 insertable within channel 13 defined between the upper and lower bars 44 and 46 in the case of retrofittable rail 16 or formed within the interior of press bed 8. The shaping members 20 extend longitudinally of and engage an elongate inner surface 23 of channel 13. Elongate inner surface 23 is opposite outer elongate surface 18 of rail 16. For the embodiment of the shaping system 12 shown in FIG. 1*a*, elongate inner surface 23 is opposite outer elongate surface 8*a* of press bed 8.

Each shaping member 20 is formed from a pair of stacked members comprising a lower wedge member 26 and an upper link member 28 (see FIG. 3) that are longitudinally movable relative to each other within channel 13. Each upper link member 28 is further comprised of a base member 30 and a contact member 32. An upper surface 33 of each contact member 32 acts as a bearing surface that bears directly against inner surface 23 of channel 13. As will be explained in detail below, co-ordinated slidable longitudinal movement of link members 28 as a group over wedge members 26 permits adjustment of the overall curved shape of inner surface 23 and hence outer surface 18 (or outer surface 8*a* for the embodiment in FIG. 1*a*.) Similarly, independent slidable longitudinal movement of individual wedge members 26 permits adjustment of one or more localized portions of the overall shape of the outer surface.

Figure 3A:
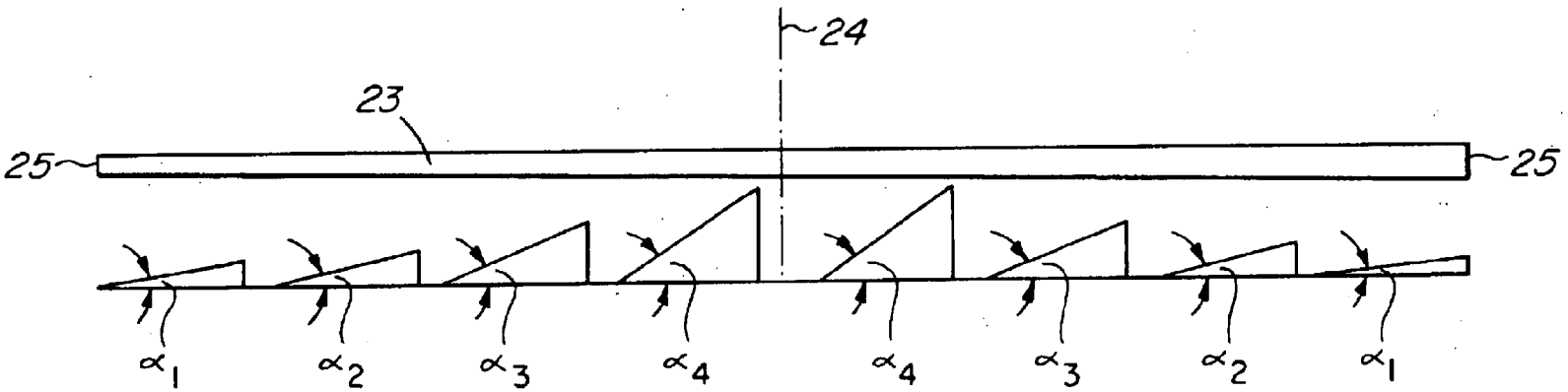
FIG. 3*a* is a schematic view showing the arrangement of the wedge members.

Referring to FIG. 3, each wedge member 26 is formed with an inclined surface 27 that is set at an angle $\alpha$. All wedge members are of substantially the same length but vary in height depending on the angle of inclined surface 27. In order to accommodate adjustment of the overall curvature of inner surface 23, wedge members 26 are arranged in the general pattern shown schematically in FIG. 3*a* along inner surface 23 such that angle $\alpha$ of each wedge member decreases from the middle 24 of elongated inner surface 23 to the distal ends 25 of the inner surface. Preferably, angle $\alpha$ differs by a constant value between each wedge member. The wedge angles illustrated in FIG. 3*a* are greatly exaggerated to make the arrangement of the wedge members clear. Examples of actual angles and length and height dimensions for an illustrative set of wedge members is set forth in Table 1 below. The wedge at one end of the set of wedges (wedge #1) has an angle of 0.2 degrees, a height at the thin end of the wedge of 0.423" and a height at the thick end of the wedge of 0.450". Each consecutive wedge that is closer to the middle of the arrangement is 0.2 degrees steeper, has a thin end height which is 0.011" thinner and a thick end height that is 0.015" thicker. This pattern continues up to the middle of the set of wedges and then works back until the last wedge (wedge #8) is substantially the same as the first wedge (wedge #1). Each wedge in this example is 7" long. It will be appreciated that the values in Table 1 are for illustrative purposes and that they can be greater or lesser values depending on the particular application.

TABLE 1

| Wedge # | Angle $\alpha$ (degrees) | Height of thin end of wedge | Height of thick end of wedge |
|---|---|---|---|
| 1 | 0.2 | 0.423" | 0.450" |
| 2 | 0.4 | 0.412" | 0.465" |
| 3 | 0.6 | 0.401" | 0.480" |
| 4 | 0.8 | 0.390" | 0.495" |
| 5 | 0.8 | 0.390" | 0.495" |
| 6 | 0.6 | 0.401" | 0.480" |
| 7 | 0.4 | 0.412" | 0.465" |
| 8 | 0.2 | 0.423" | 0.450" |

When wedge members 26 are arranged in the pattern shown in FIG. 3*a*, movement of linking members 28 as a group over the wedge members results in inner surface 23 being variable in shape between a convex configuration (positive crowning) and a concave configuration (negative crowning) due to the forces exerted by the shaping members within channel 13 on the inner surface. Deformation of inner surface 23 of channel 13 results in corresponding curvature of outer surface 18 of rail 16 (or of outer surface 8*a* of the press bed 8 for the embodiment of FIG. 1*a*).

Referring to FIG. 3, base member 30 and contact member 32 are mounted together to permit pivoting movement of contact member 32 with respect to the base member 30 so that upper bearing surface 33 will tend to automatically maintain contact with inner surface 23 over the maximum possible area at substantially all relative positions of the base member 30 with respect to the wedge member 26. This arrangement will tend to avoid or minimize point loads at inner surface 23. To achieve this automatic pivoting movement, each base member 30 and contact member 32 pair are preferably formed with one of an opposed mutually engaging concave and convex surface 35, 36. In the illustrated embodiment in FIG. 3, base member 30 is formed with an upper concave surface 35 while contact member 32 is formed with a lower convex surface 36, however, these surfaces can be reversed. Relative movement of base member 30 and wedge member 26 serves both to pivot and raise or lower contact member 32 to vary the shaping force applied by upper bearing surface 33 on inner surface 23 of channel 13.

To permit linking members 28 to be moved together as a group for crowning adjustment, base members 30 are interconnected by pivotal rigid links 34. As illustrated in FIG. 3, each rigid link 34 has two ends which are pivotally mounted between base members 30 by pins 37 that extend through aligned openings 38 in the base member and opening 39 in the link ends. Preferably, a recess 40 is formed in the ends of the base member to pivotally accommodate the link ends. It will be appreciated that alternative linking arrangements can be used and are considered equivalent.

To effect crowning, the apparatus of the present invention includes a crowning control system for controlling slidable longitudinal movement of the link members 28 as a group with respect to the wedge members 26. Referring to FIGS. 1 and 2, the crowning control system includes a control link 42 that extends from the endmost base member out channel 13. Control link 42 is connected to an actuator 44 that applies an appropriate force to move control link 42 and the interconnected link members 28. Preferably, actuator 44 is an electric or hydraulic motor with an appropriate drive system to move control link 42 longitudinally with respect to channel 13. Alternatively, actuator 44 may be manually driven. For ease of maintenance and repair, actuator 44 is preferably mounted externally to channel 13 to provide ready access, however, it is possible to install actuator 44 within the channel.

To effect localized adjustment at specific regions of the inner surface 23, a localized control system associated with each wedge member 26 is provided to permit independent slidable longitudinal movement of each wedge member 26.

Figure 3B:
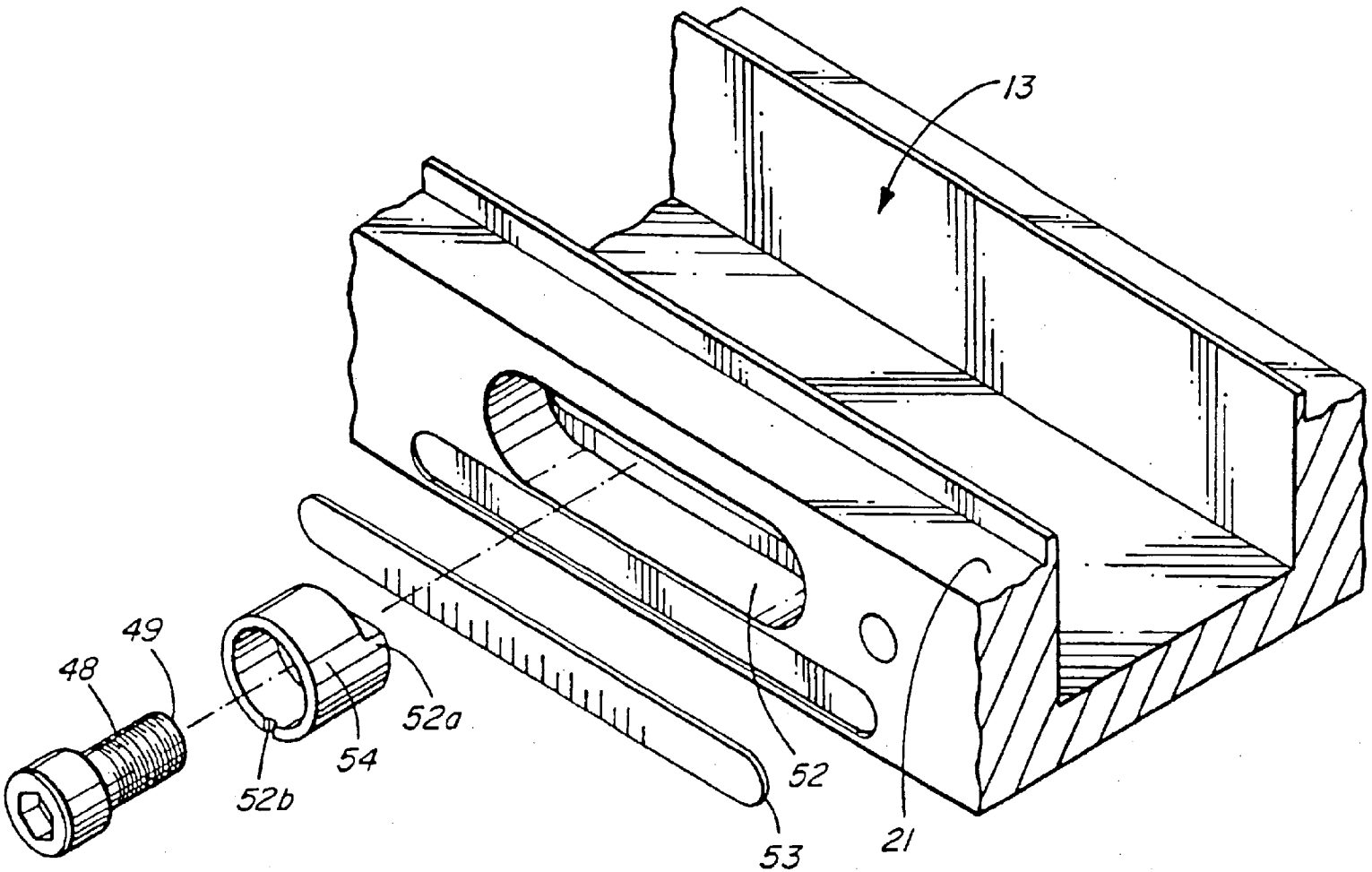
FIG. 3*b* is an exploded view showing further details of a localized control system in accordance with the first embodiment of the invention.

Referring to FIGS. 2 and 3*b*, in a preferred arrangement, the localized control system includes anchorable posts 48 (for example, a bolt) extending from each wedge member 26 to permit slidable longitudinal movement and locking of the wedge member 26 at a pre-determined location in channel 13. Posts 48 include a threaded end 49 that is received in a threaded opening 50 in the side of each wedge member 26. Elongate access ports 52 are formed in the side walls 21 of channel 13 to accommodate the posts. This allows bolt 48 (i.e. post 48), when threaded tightly against indicator washer 54, to lock the associated wedge member 26 in place against the inside of sidewall 21. When the bolt (post 48) is loosened, and still threaded in the wedge member, the bolt can be slid within access port 52 to a new position taking the wedge member with it. The bolt can be retightened to lock the wedge member in place. Indicator washer 54 acts like a regular washer between the bolt head of post 48 and the elongate access ports 52. A raised area or tooth 52*a* on the back side of each washer 54 keeps the washer from rotating as it slides in the associated access port 52. Indicator mark 52*b* is used to give position against scale 53 which for illustrative purposes is located below the access port 52.

A wedge member 26 is moved by applying appropriate force to move post 48 in slot 52 by pushing or tapping. If necessary, movement of post 48 is performed by gently tapping the post with a hammer or other suitable object.

Figure 5:
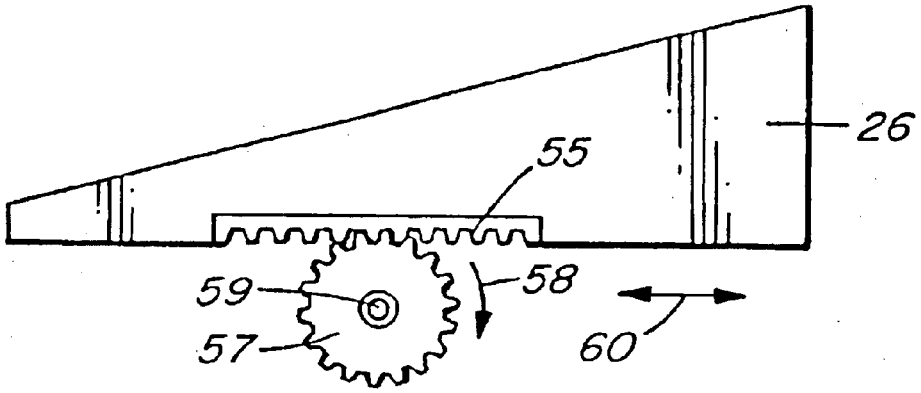
FIG. 5 is a schematic view of an alternative localized control system using a rack and gear arrangement to move individual wedge members.

An alternative localized control system is schematically shown in FIG. 5 which uses a rack 55 and a rotatable gear 57 engagable with the rack 55 to perform slidable longitudinal movement of wedge member 26. Preferably, rack 55 is mounted to or forms part of a lower surface of wedge member 26 and rotatable gear 57 is pivotally mounted to a side wall of the channel 13 such that it is accessible from the exterior. Gear 57 includes a drive opening 59 to receive an allen key or other suitable tool to permit rotation of the gear as indicated by arrow 58. Gear 57 is preferably accessible through an opening in the side wall of the channel. Rotation of gear 57 results in longitudinal movement of wedge member 26 within channel 13 in the direction of arrow 60.

Figure 6:
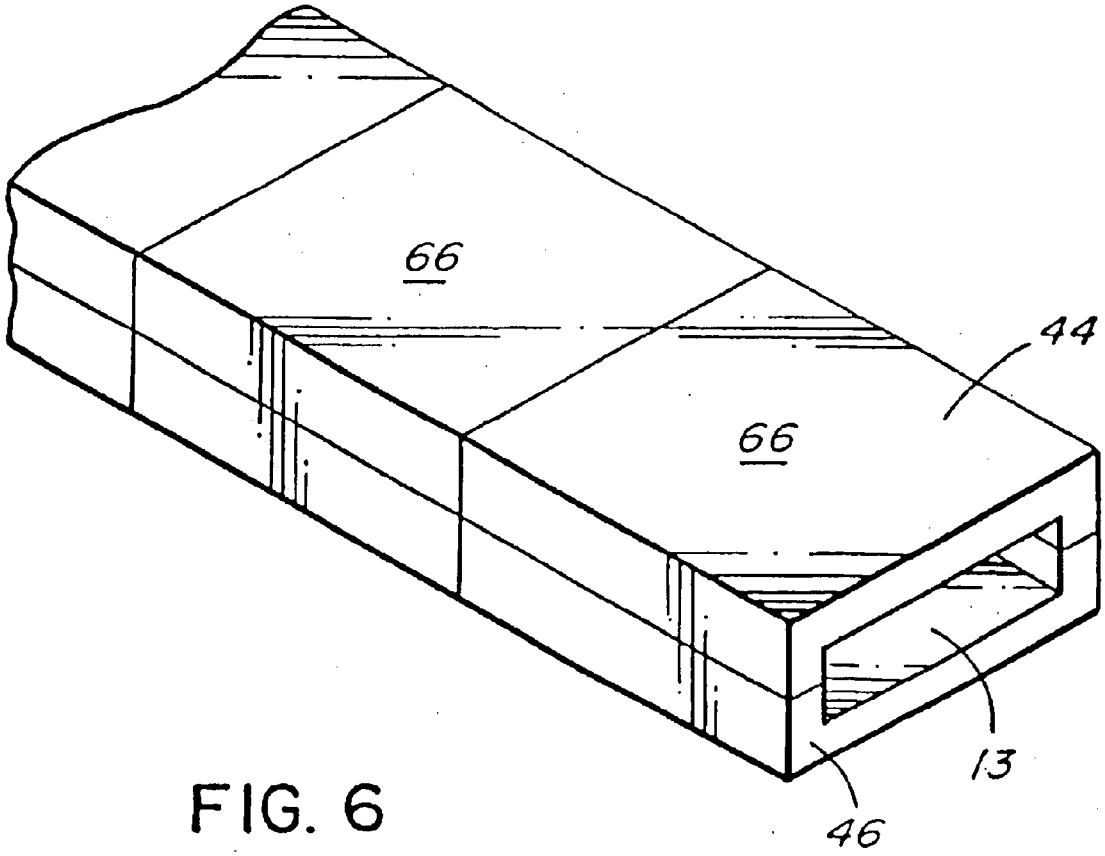
FIG. 6 is a schematic view of a modularized rail system according to an embodiment of the present invention.

The retrofittable rail 16 embodiment of the present invention shown in FIG. 2 is preferably formed using a pair of continuous elongate upper and lower bars 44 and 46. Due to the shaping system 12 being formed from a plurality of shaping members 20, it is also possible to form rail 16 from a number a longitudinally interlocking rail units 66 as shown in FIG. 6. Each interlocking unit can be dimensioned to received at least one shaping member 20 within interior channel 13. In this way, modular rails 16 of any desired length can be built up in sections from individual units 66 . This would allow rail 16 to be readily retrofittable to press equipment by making up a modular rail of appropriate length as opposed to having to rely on custom cut continuous rails for each piece of press equipment.

While specific embodiments of the invention have been described and illustrated, such embodiments should be considered illustrative of the invention only and not as limiting the invention as construed in accordance with the accompanying claims.

We claim:

1. Apparatus for adjusting the shape of an elongate member having inner and outer surfaces comprising a plurality of interconnected shaping members spaced apart from each other and extending longitudinally along the inner surface, each shaping member comprising a wedge member, a base member and a contact member engageable with the inner surface, the base member and contact member being mounted to permit pivoting movement of the contact member with respect to the base member to maintain the contact member in engagement with the inner surface at substantially all positions of the base member with respect to the wedge member such that the shaping members permit adjustment of an overall curved shape of the elongate outer surface by coordinated longitudinal movement, relative to the elongate member, of groups of the shaping members with respect to each other and adapted to permit adjustment of one or more localized portions of the overall shape of the elongate outer surface by independent longitudinal movement of one or more individual shaping members relative to the elongate outer surface.

2. A press comprising:

a frame;

an upper bending member and a lower bending member supported by the frame, the upper and lower bending members being moveable relative to each other to apply force to a workpiece placed between the upper and lower bending members; and a shape forming system associated with at least one of the upper and lower bending members for adjusting the shape of the bending member, the shape forming system comprising a plurality of interconnected shaping members spaced apart from each other and extending along the bending member, each shaping member comprising a wedge member, a base member and a contact member engageable with the bending member, the base member and contact member being mounted to permit pivoting movement of the contact member with respect to the base member to maintain the contact member in engagement with the bending member at substantially all positions of the base member with respect to the wedge member to permit adjustment of the overall curved shape of the bending member by coordinated slidable movement of the shaping members over each other in a longitudinal direction relative to the bending member and to permit localized adjustment of one or more portions of the overall shape of the bending member by independent longitudinal movement of one or more of the shaping members relative to the bending member.

3. A press as claimed in claim 2 in which the shape forming system is positioned within the interior of at least one of the bending members.

4. Apparatus for adjusting the shape of an elongate bed member in press equipment, the bed member being formed with a channel to define an elongate inner surface opposite an elongate outer surface comprising:

a plurality of shaping members insertable within the channel to extend longitudinally of and engage the inner surface, each shaping member being formed from a wedge member and an associated link member movable with respect to the wedge member, each link member being connected to adjacent link members, and each link member comprising a base member adjacent the wedge member and a contact member engageable with the inner surface, the base member and the contact member being mounted together to permit pivoting movement of the contact member with respect to the base member to maintain the contact member in engagement with the inner surface at substantially all positions of the base member with respect to the wedge member;

whereby coordinated slidable longitudinal movement of the link members over the wedge members permits adjustment of the overall curved shape of the outer surface and independent slidable longitudinal movement of individual wedge members permits adjustment of one or more localized portions of the overall shape of the outer surface.

5. Apparatus as claimed in claim 4 wherein each wedge member is formed with an inclined surface at angle $\alpha$ and the wedge members are arranged in a pattern along the inner surface such that angle $\alpha$ decreases from the middle of the inner surface to distal ends of the inner surface.

6. Apparatus as claimed in claim 4 wherein each base member and contact member are formed with one of an opposed mutually engaging convex and concave surface to permit pivoting of the contact member.

7. Apparatus as claimed in claim 6 in which the contact member includes a bearing surface adapted to remain in contact with the inner surface at substantially all positions of the base member with respect to the wedge member whereby relative movement of the base member and the wedge member serves to pivot and raise or lower the contact member to exert a greater or lesser shaping force on the inner surface.

8. Apparatus as claimed in claim 4 wherein the base members are interconnected by rigid links having two ends.

9. Apparatus as claimed in claim 8 wherein the ends of each rigid link are pivotally mounted to each base member.

10. Apparatus as claimed in claim 4 further comprising a crowning control system for controlling slidable longitudinal movement of the link members as a group with respect to the wedge members.

11. Apparatus as claimed in claim 10 wherein the crowning control system comprises an actuator and a control link extending between the actuator and one of the link members.

12. Apparatus as claimed in claim 11 wherein the elongate surface is formed from a top bar and a bottom bar that co-operate to define the channel within the elongate surface housing the shaping members with the control link extending from the channel to the actuator positioned externally of the channel.

13. Apparatus as claimed in claim 4 wherein the elongate surface is formed from a top bar and a bottom bar that co-operate to define the channel within the elongate surface housing the shaping members with the control link extending from the channel to the actuator positioned externally of the channel.

14. Apparatus as claimed in claim 10 wherein the elongate surface is formed from a top bar and a bottom bar that co-operate to define the channel within the elongate surface housing the shaping members with the control link extending from the channel to the actuator positioned externally of the channel.

15. Apparatus as claimed in claim 4 further comprising a localized control system associated with each wedge member to permit slidable longitudinal movement of each wedge member.

16. Apparatus as claimed in claim 15 wherein the localized control system comprises an anchorable post extending from each wedge member to permit slidable longitudinal movement and locking of the wedge member at a predetermined location.

17. Apparatus as claimed in claim 16 wherein the elongate surface is formed from a top bar and a bottom bar that co-operate to define the channel which houses the shaping members, the channel having side walls formed with access ports through which the anchorable posts extend from each wedge member to permit longitudinal movement of the wedge members.

18. Apparatus as claimed in claim 4 wherein the localized control system comprises a rack and a rotatable gear engagable with the rack associated with each wedge member to permit slidable longitudinal movement of the wedge member on rotation of the gear.

19. Apparatus as claimed in claim 18 wherein the elongate surface is formed from a top bar and a bottom bar that co-operate to define the channel which houses the shaping members, the channel having side walls with the rotatable gear being pivotally mounted to one of the side walls to engage the rack which is mounted to the wedge member, the rotatable gear being rotatable via an access port in the one side wall.

20. Apparatus for adjusting the shape of an elongate member in press equipment comprising:

a channel in the elongate member defining an elongate inner surface opposite to an outer elongate surface;

means for shaping the elongate member extending longitudinally of and engaging the inner surface, the means for shaping comprising a plurality of interconnected shaping members, each shaping member having separate wedge means and linking means for joining to adjacent shaping members with each linking means comprising a base member adjacent the wedge member and a contact member engagable with the inner surface, the base member and the contact member being mounted together to permit pivoting movement of the contact member with respect to the base member to maintain the contact member in engagement with the inner surface at substantially all positions of the base member with respect to the wedge member;

whereby coordinated slidable longitudinal movement of the linking means as a group over the wedge means permits adjustment of the overall curved shape of the outer surface and independent slidable longitudinal movement of individual wedge means permits adjustment of one or more localized portions of the overall shape of the outer surface.

21. Apparatus as claimed in claim 20 in which the wedge means comprises:

a member with an inclined surface at angle $\alpha$.

22. Apparatus as claimed in claim 20 including a plurality of wedge members arranged in a pattern along the inner surface such that angle $\alpha$ decreases from the middle of the inner surface to distal ends of the inner surface.

23. Apparatus as claimed in claim 20 wherein each base member and contact member are formed with one of an opposed mutually engaging convex and concave surface to permit pivoting of the contact member.

24. Apparatus as claimed in claim 20 in which the contact member includes a bearing surface adapted to remain in contact with the inner surface at substantially all positions of the base member with respect to the wedge member whereby relative movement of the base member and the wedge member serves to pivot and raise or lower the contact member to exert a greater or lesser shaping force on the inner surface.

25. Apparatus as claimed in claim 24 wherein the ends of each rigid link are pivotally mounted to each base member.

26. Apparatus as claimed in claim 20 wherein base members are interconnected by rigid links having two ends.

* * * * *